US006040757A

United States Patent [19]

Masuda et al.

[11] Patent Number: 6,040,757

[45] Date of Patent: Mar. 21, 2000

[54] VARIABLE RESISTOR

[75] Inventors: Fumitoshi Masuda; Masashi Morikami, both of Fukui-ken, Japan

[73] Assignee: Murata Manufacturing Co., Ltd., Nagaokakyo, Japan

[21] Appl. No.: 09/257,530

[22] Filed: Feb. 25, 1999

[30] Foreign Application Priority Data

Mar. 3, 1998 [JP] Japan ..... 10-069549

[51] Int. Cl.[7] ..... H01C 10/30

[52] U.S. Cl. ..... 338/160; 338/162; 338/164; 338/166

[58] Field of Search ..... 338/160, 162, 338/164, 166, 167, 170

[56] References Cited

U.S. PATENT DOCUMENTS

| | | | |
|---|---|---|---|
| 3,579,169 | 5/1971 | Dickinson | 338/170 |
| 3,631,371 | 12/1971 | Maurice | 338/164 |
| 3,654,581 | 4/1972 | Franz, Jr. | 338/162 |
| 4,109,230 | 8/1978 | Frey, Jr. | 338/164 |
| 4,329,676 | 5/1982 | McDonald et al. | 338/198 |

*Primary Examiner*—Lincoln Donovan
*Assistant Examiner*—Richard K. Lee
*Attorney, Agent, or Firm*—Burns, Doane, Swecker & Mathis, LLP

[57] ABSTRACT

Slack in the engagement of a shaft 5 and a rotor 3 in a case 1 is prevented by the resiliency of an O ring 6 under radial but not axial compression. Even if heat stress is added, the variable resistor which can secure air-tightness is provided. The rotor 3 and a slider 4 are accommodated in the case 1. A resistance substrate 2 having a collector electrode 25 formed on the central portion of the surface and a circular resistor 24 formed concentrically on the periphery of the collector electrode 25 is engaged with the lower end part of the case 1. A stepped surface 12 supporting the peripheral surface and the bottom surface of the O ring 6 is formed on the upper surface of the case. A boss portion 55 contacting the inner circumference of the O ring 6 and an operating portion 51 projecting on the upper surface of the case 1 and covering the stepped surface 12 is formed on the shaft 5. The inner and outer circumferences of the O ring 6 are pressed and contacted with the stepped surface 12 of the case and the boss portion 55 of the shaft 5. A gap δ is provided between either upper or lower end surface of the O ring 6 and the stepped surface 12 or the bottom surface of the operating portion 51.

20 Claims, 4 Drawing Sheets

VARIABLE RESISTOR

BACKGROUND OF THE INVENTION

1. Field of the Invention

This invention relates to the small-sized variable resistor which is used for a hearing aid, a measuring device, a communication apparatus, a sensor, in addition to industrial apparatuses, etc.

2. Description of the Related Art

In recent years, the reduction of size and weight of various apparatuses has been demanded. Among them, the size of hearing aids has become smaller. The progression has been from the pocket type to the ear suspending/hanging type, and further to in an ear canal type (canal type). In the ear canal type, a person can wear the main body of the hearing aid in the ear canal. In the ear canal type hearing aid, smaller components are particularly required. Moreover, in the case of the hearing aid of an ear canal type, the humidity is high when it is worn. Since there is a possibility that sweat may permeate inside the hearing aid and cause a failure, a waterproof and moisture-proof structure is desired for a variable resistor which is used in the apparatus.

The applicant has disclosed a reliable micro variable resistor. See, for example, Japanese Patent Application No. 9-157741, Japanese Patent Application No. 9-365166. FIG. 1–3 of the present application shows an example of it. This variable resistor comprises a case 1, a resistance substrate 2, a rotor 3, a slider 4, and a shaft 5 for external operation. On the upper surface of the case 1, a circular opening hole 11 and a stepped surface 12 on the periphery thereof are formed. The stepped surface 12, on which an O ring 6 is disposed, has an annular ring shape. Further, a recess 13 in the shape of an annular ring, which a part of the shaft 5 fits, is formed on the periphery of the stepped surface 12. An internal space 14 of a cylindrical shape contains the rotor 3 and the slider 4 and is formed on the inside of the case 1. A stopper part 15 (FIG. 3) protrudes into the internal space 14.

As shown in FIG. 1 the resistance substrate 2 defines a rectangular plate which fits to an opening 16 of the case 1 at the lower end. Sealing resin 20 is injected in the gap between the resistance substrate 2 and the lower-end opening 16, and in the hole at the base of the resistance substrate 2 (FIG. 3). The lower-end opening 16 of the case 1 is thus sealed. A first terminal 21 is inserted in the resistance substrate 2 toward the central portion of the resistance substrate 2 from one side. Second and third terminals 22 and 23 are insert-molded to project toward the central portion from the opposing side. Recesses 19*a*, 19*b*, 19*c* in lower edges 18 of the case 1 receive the first through third terminals 21, 22, 23 when the resistor substrate 2 is sealed to the bottom of the case 1.

One end of the first terminal 21 is exposed to the surface of the central portion of the resistance substrate 2 forms a collector electrode 25. One of the end parts 22*a* and 23*a* of each of the second and third terminals 22 and 23 are also exposed to the surface of the resistance substrate 2. A circular resistor 24 is formed on the exposed electrode end parts 22*a* and 23*a*. The resistor 24 is formed concentrically on the periphery of the collector electrode 25.

A sleeve 31 protrudes from the middle of the rotor 3 at the upper surface. The sleeve 31 is inserted into the opening hole 11 of the case 1 and is rotatable. An insertion hole 32 is formed so as to penetrate the central part of the sleeve 31 along its axis. A notch groove 33 is formed in the diameter direction on the upper end of the sleeve 31. A disc-shaped flange portion 34 is formed on the lower part of the rotor 3.

A stopper part 35 protrudes in the radial direction from the flange portion 34. When either side of the stopper part 35 abuts both sides of the stopper part 15 of the case 1 (FIG. 3), the rotation angle of the rotor 3 is limited. A recess for fitting the slider 4 is formed on the bottom surface of the rotor 3, particularly the bottom of the flange portion 34 and the stopper part 35.

The slider 4 is made of the conductive metal plate having springy or elastic property, such as a copper alloy, a stainless steel, and a precious-metal group alloy. A base portion 41 is provided as part of the slider 4 in the central section so as to be attached with the rotor 3 with the aid of tabs 44 on two edges of the slider 4. An approximately U-shaped first arm portion 42 is formed on one end of the base portion 41. A second arm portion 43 is formed on the other end. The first and second arm portions 42 and 43 are respectively bent in the opposing direction to form bent portions 42*b* and 43*b*. A first contact-portion 42*a* (FIG. 3) slidably contacted with the circular resistor 24 is formed on the end of the first arm portion 42. A second contact-portion 43*a* (FIG. 3) having a hemisphere surface which contacts the collector electrode 25 is integrally formed on the end of the second arm portion 43.

The shaft 5 has a large diameter operating part 51 on one end. A groove 52 for engaging a driver is formed in the diameter direction on the surface of the operating part 51. A small diameter axial part 53 protrudes at the other end of the shaft 5 so as to be inserted into the insertion hole 32 of the rotor 3. Two projection parts 54 are formed on the sides of the axial part 53 symmetrically to be engaged with the notch groove 33 of the rotor 3.

The assembly of shaft 5 to the above-mentioned case 1 is performed as follows. The O ring 6 is arranged on the step surface 12 of the case 1. The axial part 53 of the shaft 5 is inserted into the insertion hole 32 of the rotor 3 contained inside the case 1. The projection part 54 of the axial part 53 fits into the notch groove 33 of the rotor 3. Thus, relative rotation in relation to the shaft 5 and the rotor 3 is prevented. The rotor 3 and the shaft 5 are integrated by crimping and expanding an end portion of the axial part 53 which projects to the lower surface of the rotor 3. A crimped portion 53*a* is shown in FIG. 3. In this state, the O ring 6 is pressed and maintained between the internal surface of the operating part 51 of the shaft 5 and the bottom of the step surface 12, the gap between the shaft 5 and the case 1 is sealed.

As mentioned above, when the O ring 6 is pressed in the axial direction between the shaft 5 and the case 1, stress to loosen the engagement of the shaft 5 and the rotor 3 effects by the resiliency of O ring 6. In the case of a small-sized variable resistor, reflow soldering is used commonly as for the mounting method to a circuit board. However, under the condition that the resiliency of O ring 6 exists, heat of the reflow soldering tends to generate a heat transformation, because heating is conducted under high stress and the heat-resistant temperature of components becomes lower. This means that the heat of the reflow soldering causes the shaft 5 to float and an unnecessary gap to form between the rotor 3 and the shaft 5. There was a possibility that a reduction of the air-tightness, or hermeticity, might be caused. Moreover, since electric insulation is required, the rotor 3 and the shaft 5 are often formed with a heat resistant resin. Among them, when a thermoplastic resin which has good fabricability and workability is used, there was a problem that it was easy to receive the influence of the above-mentioned heat.

SUMMARY OF THE INVENTION

Accordingly, an object of this invention is to prevent the generation of slack between the shaft and the rotor caused by a change in the resiliency of an O ring. Another object is to provide a variable resistor with secure air-tightness, hermeticity, even if heat stress is imposed.

In order to achieve the above-mentioned objects, a variable resistor of the present invention comprises a case, a rotatable rotor inside the case, a shaft projected on the upper surface of the case and engaged with the rotor. Further, a resistance substrate having a collector electrode on the central portion of the surface thereof and a circular resistor formed concentrically on the periphery of the collector electrode is stored in the case. A slider having a first contact portion contacting the collector electrode and a second contact portion slidably contacting the resistor is provided with the rotor. A stepped surface supporting the peripheral surface and the bottom surface of an O ring is formed on the upper surface of the case. A boss portion contacting the inner circumference of the O ring is formed on the shaft. An operating portion projecting on the upper surface of the case and covering the stepped surface of the case is formed on the shaft. The inner and outer circumferences of the O ring are pressed and contacted with the stepped surface of the case and the boss portion of the shaft. A gap is provided between either the upper or lower end surface of the O ring and the stepped surface and the bottom surface of the operating portion.

The inner and outer circumference of the O ring contacts in a radial direction the stepped surface of the case and the boss portion of the shaft. The gap is provided such that the stress is not affected in the axial direction. Therefore, the slack in the engagement of the shaft and the rotor by the resiliency of the O ring can be prevented. Even if heat stress is added at the time of the soldering, floating of the shaft does not occur since the resiliency of the O ring does not affect to the axial direction of the shaft, thus air-tightness or hermeticity is not reduced.

Moreover, as another aspect of the present invention, a variable resistor comprises a case, a rotatable rotor inside the case, a shaft projected on the upper surface of the case and engaged with the rotor. Further, a resistance substrate having a collector electrode on the central portion of the surface thereof and a circular resistor formed concentrically on the periphery of the collector electrode is stored in the case. A slider having a first contact portion contacting the collector electrode and a second contact portion slidably contacting the resistor is provided with the rotor. A stepped surface supporting the peripheral surface and the bottom surface of an O ring is formed on the upper surface of the case. A boss portion contacting the inner circumference of the O ring is formed on the shaft. An operating portion projecting on the upper surface of the case and covering the stepped surface of the case is formed on the shaft. The O ring is formed in the ellipse such that cross section of the O ring has a major axis thereof in the radial direction. The length of major axis of the ellipse is formed longer than the distance in the radial direction between the stepped surface and the boss portion. The O ring is pressed and fitted into between the stepped surface of the case and the boss portion of the shaft by providing a twisting or warping force to the O ring. Thus the O ring is pressed to contact the stepped surface of the case and the boss portion of the shaft.

In this case, since using the twist of the O ring having the elliptical cross section the O ring is pressed to contact the boss portion of the shaft and the stepped surface of the case in the radial direction, a reliable air-tightness or hermeticity can be secured without generating shaft float.

BRIEF DESCRIPTION OF THE DRAWINGS

The present invention will now be described by way of exemplary embodiments to which it is not limited as shown in the accompanying drawings, wherein.

DETAILED DESCRIPTION OF PREFERRED EMBODIMENTS

Figure 3:
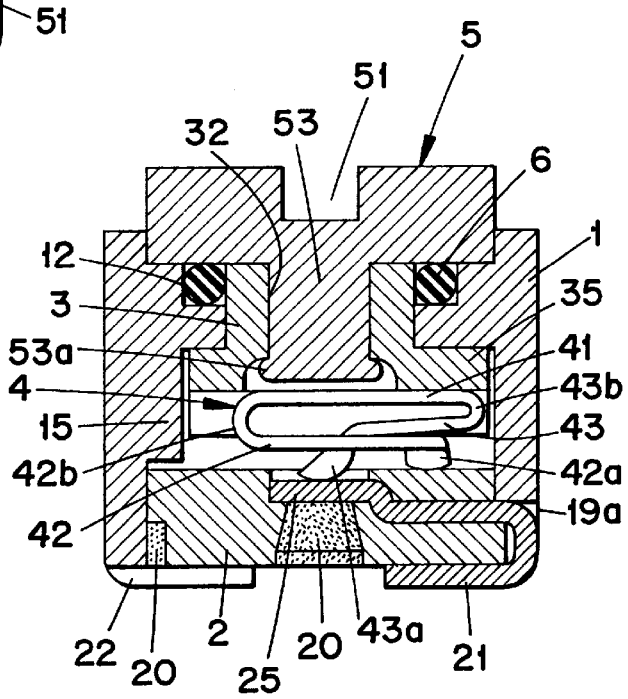
FIG. 3 (PRIOR ART)
FIG. 3 is a sectional view taken along a line III—III of FIG. 2.
Figure 4:
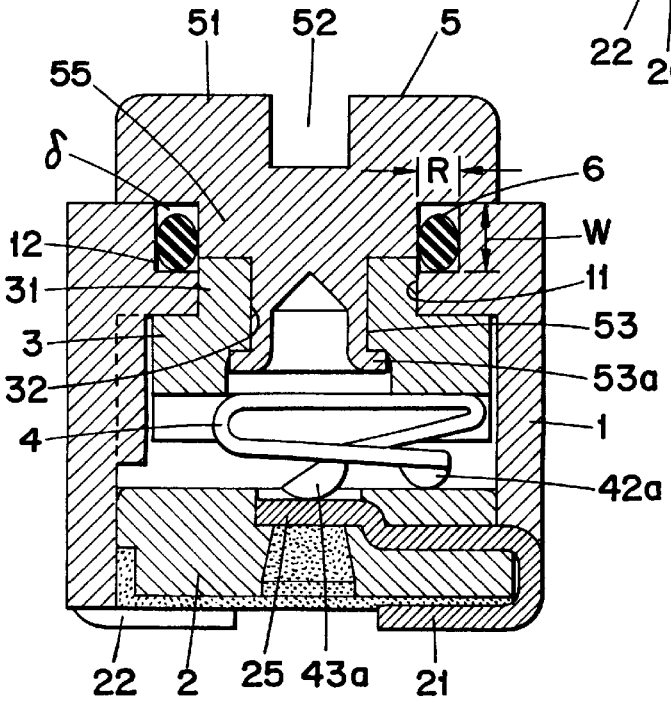
FIG. 4 is a sectional view of the variable resistor according to a preferred embodiment of the present invention.
Figure 5:
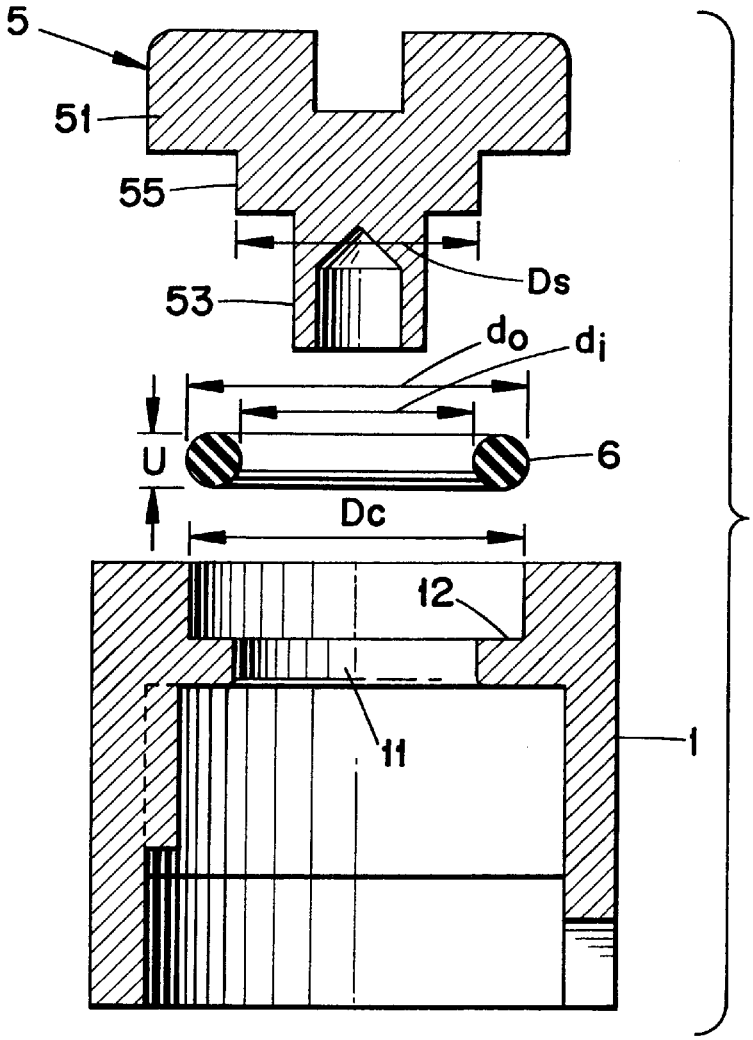
FIG. 5 is an exploded sectional view of the shaft, the O ring and the case of the variable resistor of FIG. 4.
Figure 6:
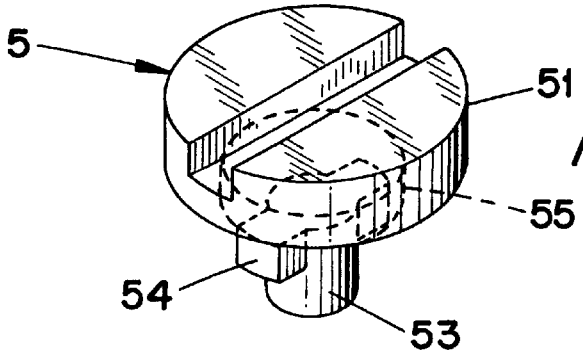
FIG. 6 is a perspective view of the shaft of the variable resistor of FIG. 4.

FIGS. 4–6 shows an example of a variable resistor according to the present invention. This variable resistor is partially changed with respect to the variable resistor shown in FIGS. 1–3. The same reference numerals used in FIGS. 1–3 are used for the same members in FIGS. 4–7 and the corresponding explanation is not repeated in it entirety.

On the upper surface of a case 1 the circular opening 11 and the stepped surface 12 having an annular shape with the O ring 6 disposed on the periphery thereof are formed. However, the recess 13 having an annular shape which fits a part of the shaft 5 shown in FIGS. 1–3 is not formed.

Figure 1:
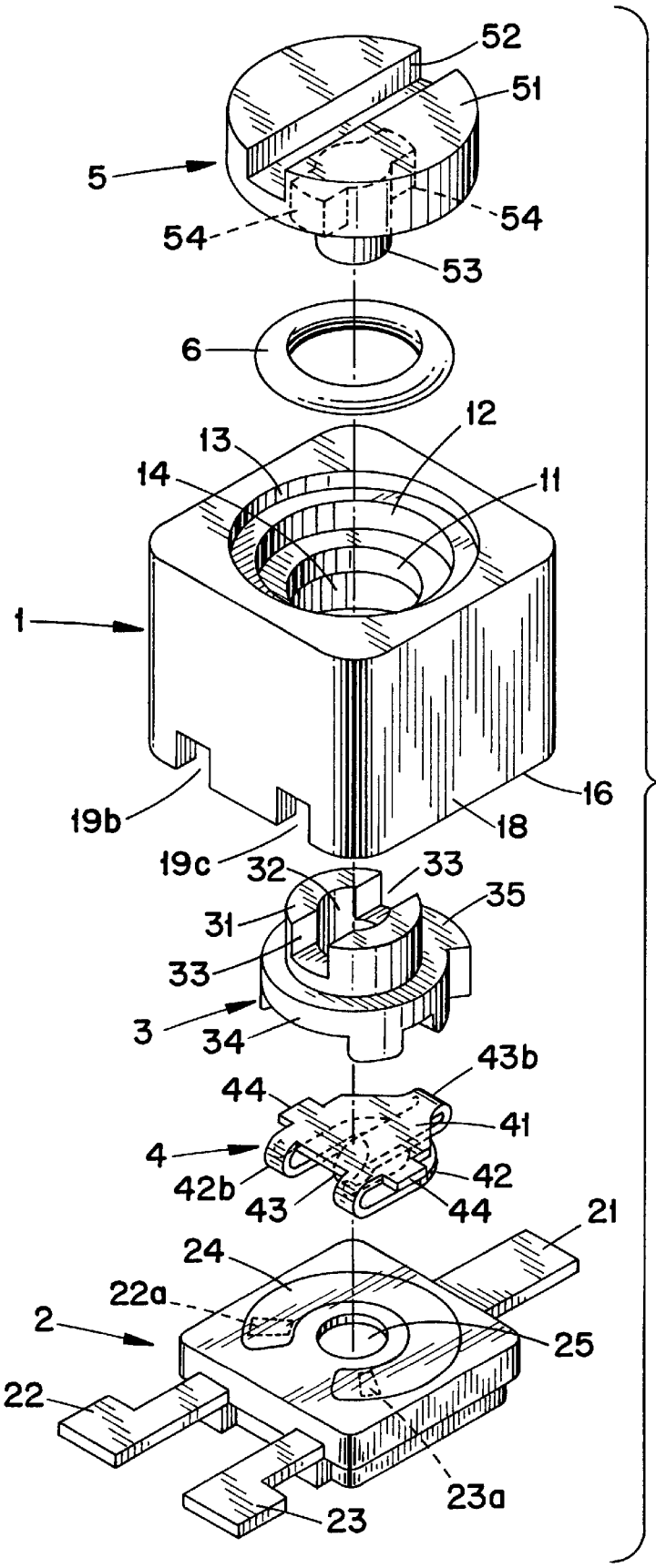
FIG. 1 (PRIOR ART)
FIG. 1 is an exploded perspective view of an example of a conventional variable resistor.
Figure 2:
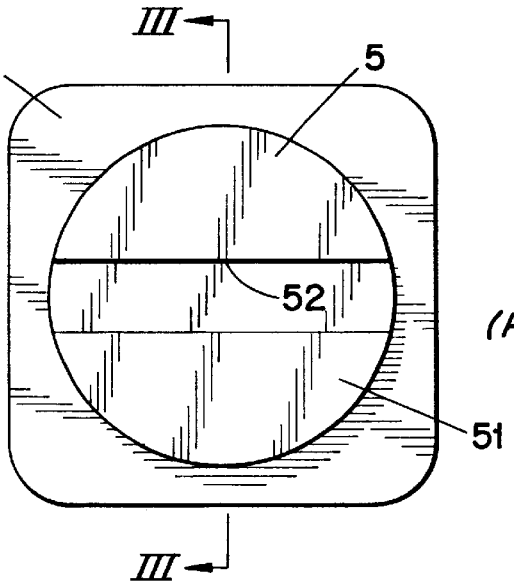
FIG. 2 (PRIOR ART)
FIG. 2 is a plan view of the variable resistor of FIG. 1.

A rotor 3 has the same shape as the rotor 3 shown in FIGS. 1–3, except that the sleeve 31 protruding on the upper part of the rotor 3 is formed fairly short so as not to contact the O ring 6.

The shaft 5 is made of metals with simple plastic working characteristics, such as copper, a copper alloy, red brass or the like. As shown in FIG. 5 and FIG. 6, the cylindrical shaped boss portion 55 is formed between the operating part 51 and the axial portion 53. In this embodiment, the axial portion 53 is formed to be hollow. The axial portion 53 is inserted into the insertion hole 32 of the rotor 3. An end portion of the axial portion 53 is crimped so as to be extended or flattened to the outside and a crimped portion 53*a* is formed. Thus the shaft 5 is engaged with the rotor 3. The shaft 5 and the rotor 3 are rotatably engaged by engaging the groove 33 of the rotor 3 with a protrusion 54 (shown in FIG. 6) of the shaft 5. The operating part 51 formed on the upper end of the shaft 5 covers the stepped surface 12 of the case 1. In addition, plating may be applied on the surface of the shaft 5 for rust-proofing. Gold, silver, or a palladium plating or the like is preferable to serve as both ornament property and metal allergy prevention.

The O ring 6 arranged on the stepped surface 12 is made of silicone rubber, fluororubber, fluorosilicone rubber or the like such that the packing effect and the electrical characteristics to the heat changes of the soldering or the operating temperature can be stablely obtained. The O ring 6 has a circular shape in cross section in a free condition (i.e., when stress is not imposed on the O ring 6). The diameter U of the O ring 6 is smaller than the depth W of the stepped surface 12 and is larger than the distance R in the radial direction between the inner circumference of the stepped surface 12 and the outer circumference of the boss portion 55. The relationships of U, R and W are expressed as follows:

$$R<U<W.$$

In this embodiment, the inner diameter di of the O ring 6 in the free condition is smaller than the outer diameter Ds of the boss portion 55 of the shaft 5. The outer diameter do of the O ring 6 is made equal to or larger than the inner diameter Dc of the stepped surface 12 of the case 1. These relationships are expressed as follows:

$$di<Ds,$$

$$do \geqq Dc.$$

Then the O ring 6 is fitted into the stepped surface 12 of the case 1 and the shaft 5 is fitted into the case 1. In this state, the inner and outer circumference of the O ring 6 is compressed in the direction of the diameter between the inner circumference of the stepped surface 12 and the outer circumference of the boss portion 55. As shown in FIG. 4, the O ring 6 is transformed to have an ellipse shaped cross-section having a major length in the axial direction (in the vertical direction of FIG. 4). A gap δ is provided between either upper or lower end surface of the O ring 6 and the bottom surface of the operating portion 51 of the shaft 5 or the upper surface of the stepped surface 12.

As described above, since the inner and outer circumference of the O ring 6 is pressed to contact and supported in the radial direction between the inner circumference of the stepped surface 12 of the case 1 and the outer circumference of the boss portion 55, the case 1 and the shaft 5 can be sealed reliably. Moreover, since the gap δ is provided such that the stress does not affect adversely in the axial direction of the O ring 6, slackening or loosening of the engagement of the shaft 5 and the rotor 3 can be prevented. Even if the thermal stress is imposed at the time of the reflow soldering, the shaft 5 does not float in the case 1 because the resiliency of the O ring 6 does not affect to the axial direction of the shaft 5 and thus the reduction of air-tightness or hermeticity can be avoided.

In the above embodiment, as shown in FIG. 5 the O ring 6 having a circular shape in the cross section in the state without any stress being imposed is used. However, it is not restricted to this case. O rings having cross-sectional shapes, such as an elliptical shape, a star shape, and a square shape, may be used.

Figure 7A:
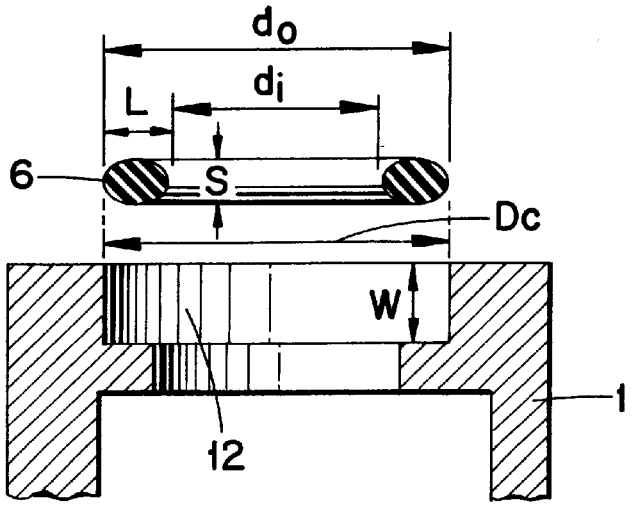
FIGS. 7A, 7B and 7C are explanatory views showing the assembly process of a variable resistor according to a second preferred embodiment of the present invention.
Figure 7B:
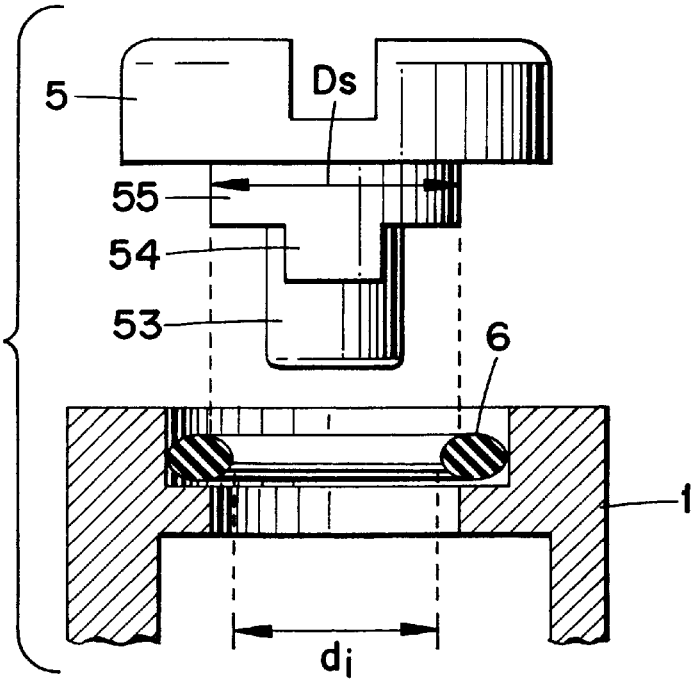
Figure 7C:
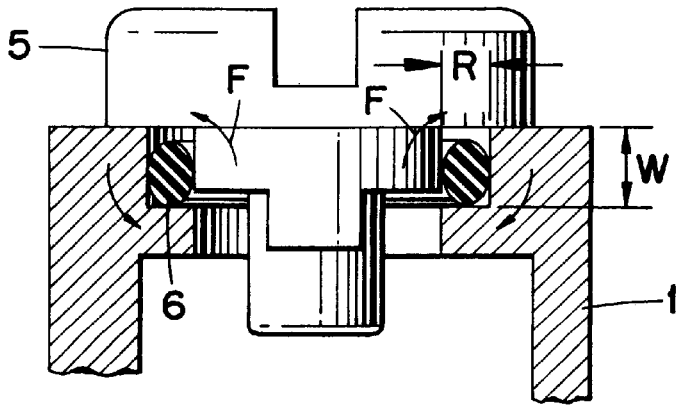

FIGS. 7A, 7B and 7C show a second preferred embodiment of the present invention. In this embodiment, the cross-sectional shape of the O ring 6 in the free state is made elliptical in the radial direction, as shown in FIG. 7A. The cross-sectional length L (major axis) in the direction of axial diameter of the shaft 5 is larger than cross-sectional length S (breadth) in the direction of axial center of the shaft 5. The major axis L is smaller than the depth W of stepped surface 12. The major axis L is larger than the distance R in the radial direction between the inner circumference of the stepped surface 12 and the outer circumference of the boss portion 55. Moreover, the breadth S is equal to or smaller than the distance R in the radial direction between the inner circumference of the stepped surface 12 and the outer circumference of the boss portion 55. The relationships of the major axis L, the breadth S, the distance R and the depth W are expressed as follows:

$$S \leqq R<L<W.$$

Moreover, as show in FIG. 7B the inner diameter di of the O ring 6 is smaller than the outer diameter Ds of the boss portion 55 of the shaft 5. The outer diameter do of the O ring 6 is nearly equal to the inner diameter Dc of the stepped surface 12 of the case 1. The relationships of the inner and outer diameter of the O ring 6 di and do, the outer diameter Ds of the boss portion 55 and the inner diameter Dc of the stepped surface 12 are expressed as follows:

$$di<Ds,$$

$$do \approx Dc.$$

After the O ring 6 is fitted into the stepped surface 12 of the case 1, the shaft 5 is fitted into the case 1. The inner circumference of the O ring 6 is pressed by the end surface of the boss portion 55. Thus, the O ring 6 becomes twisted approximately 90 degrees in the cross sectional view. Therefore, the material's memory or stability to return to the original state works toward the O ring 6 (indicated by an arrow F in FIG. 7C). Due to the stability, the O ring 6 is pressed to contact the inner circumference of the stepped surface 12 of the case 1 and the outer circumference of boss portion 55 and the O ring 6 seals securely.

Since the depth W of the stepped surface 12 is made larger than the major-axis L of the O ring 6 in the elliptical cross section, the gap is definitely formed between either upper or lower end surface of the O ring 6 and the bottom surface of the operating portion 51 of the shaft 5 or the upper surface of the stepped surface 12. Hence, the resiliency of the O ring 6 in the axial direction does not affect the shaft 5 adversely.

In addition, the engaging method of the shaft 5 and the rotor 3 is not restricted by above embodiments. Instead of mechanically crimping the end of the axial portion 53 of the shaft 5, a claw portion may be formed on the axial portion 53, for example. When the axial portion 53 is inserted into the insertion hole 32 of the rotor 3, the claw portion may be engaged with the reverse side of the insertion hole 32 so as to prevent the axial portion 53 from removing or dropping inadvertently. Moreover, in case that the shaft 5 is made of thermoplastic resin crimping may be performed by heat. Furthermore, other fixing means, such as a screw, a bonding or the like, may be employed.

Moreover, the slider 4 is not restricted to the embodiment of the present invention as the slider 4 is formed such the first arm portion 42 having a U-shaped and the second arm portion 43 having a bar shape are bent in opposing directions. Sliders having various shapes can be employed.

Moreover, the stepped surface 12 of the upper surface of the case 1 may be made deeper beforehand. Like the case 1 shown in FIG. 1, the recess 13 can also be provided in the periphery of the stepped surface 12.

As clearly explained above, since the inner and outer circumferences of the O ring is pressed to contact and supported between the stepped surface of the case and the boss portion of the shaft, then the gap is provided such that the stress might not affect adversely in the axial direction, the load to the engagement of the shaft and the rotor due to the thermal stress from the soldering or the operating environment can be reduced. Thus, the slacking or loosening and floating of the shaft can be prevented and the air-tightness can be maintained. Therefore, the reliable variable resistor with respect to environmental characteristics, particularly humidity, can be obtained.

Moreover, since the O ring is pressed to contact the boss portion of the shaft, and the stepped surface of the case by using the twist of the O ring having elliptical shape in the cross section, a highly variable resistor can be obtained with respect to environmental characteristics.

The present invention has been described by way of exemplary embodiments to which it should not be limited. Variations and modifications will occur to those skilled in the art which are within the spirit and scope of the present invention as determined by the appended claims.

What is claimed is:

1. A variable resistor comprising:

a case;

a rotatable rotor accommodated in the case;

a shaft projecting from an upper surface of the case being engaged with the rotor;

a resistance substrate having a collector electrode formed on the central portion of the surface thereof and a circular resistor formed concentrically on the periphery of the collector electrode being accommodated in the case; and a slider having a first contact portion contacting the collector electrode and a second contact portion slidably contacting the resistor being provided with the rotor, wherein the case includes a stepped surface on an upper surface of the case, the stepped surface supporting the peripheral surface and the bottom surface of an O ring, the shaft includes a boss portion contacting the inner circumference of the O ring and an operating portion projecting from the upper surface of the case and covering the stepped surface of the case, the inner and outer circumferences of the O ring are in compressed contact with the stepped surface of the case and the boss portion of the shaft, and a gap is provided between either upper or lower end surface of the O ring and the stepped surface and the bottom surface of the operating portion.

2. A variable resistor in accordance with claim 1, wherein said shaft is made of metals displaying simple plastic working characteristics.

3. A variable resistor in accordance with claim 2, wherein said metals are selected from a group of metals consisting of copper, a copper alloy, and red brass.

4. A variable resistor in accordance with claim 1, wherein said shaft includes a hollow axial portion, an end of which is crimped.

5. A variable resistor in accordance with claim 1, wherein the O ring is made of a rubber material selected from a group consisting of silicone rubber, fluororubber, fluorosilicone rubber.

6. A variable resistor in accordance with claim 1, wherein the O ring in a non-stressed condition has a diameter U and the stepped surface has a depth W and a distance R in the radial direction between the inner circumference of the stepped surface and the outer circumference of the boss portion, the diameter U, the depth W and the distance R having the following relationship:

$$R<U<W.$$

7. A variable resistor in accordance with claim 1, wherein the O ring in a non-stressed condition has an inner diameter di and an outer diameter do, and the boss portion has a outer diameter Ds and the stepped surface of the case has an inner diameter Dc with the following relationship:

$$di<Ds$$

$$do\geqq Dc.$$

8. A variable resistor in accordance with claim 1, wherein, in assembled state, the O ring is transformed from having an circular cross section to an ellipse shaped cross-section with a major length in the axial direction of the shaft.

9. A variable resistor in accordance with claim 1, wherein the O ring in a non-stressed condition has a cross-section selected from a group of cross-sections consisting of a circular shape, an elliptical shape, a star shape, and a square shape.

10. A variable resistor comprising:

a case;

a rotatable rotor accommodated in the case;

a shaft projecting from an upper surface of the case being engaged with the rotor;

a resistance substrate having a collector electrode formed on the central portion of the surface thereof and a circular resistor formed concentrically on the periphery of the collector electrode being accommodated in the case; and a slider having a first contact portion contacting the collector electrode and a second contact portion slidably contacting the resistor being provided with the rotor, wherein the case has a stepped surface on an upper surface of the case, the stepped surface supporting the peripheral surface and the bottom surface of an O ring, the shaft includes a boss portion contacting the inner circumference of the O ring and an operating portion projecting on the upper surface of the case and covering the stepped surface of the case, and the O ring in a non-stressed condition has an elliptical cross-section with a major axis of the cross section in the radial direction wherein a length of major axis of the ellipse is longer than the distance in the radial direction between the stepped surface and the boss portion, and the O ring is dimensioned to be pressed and fitted into between the stepped surface of the case and the boss portion of the shaft to apply a twisting or warping force to the O ring.

11. A variable resistor in accordance with claim 10, wherein the O ring in a non-stressed condition is elliptical in the radial direction with a cross-sectional length L along a major axis and a cross-sectional thickness S, the stepped surface has a depth W in an axial direction of the shaft and a distance R exists between an inner circumference of the stepped surface and an outer circumference of the boss portion with the following relationship the major axis L, the thickness S, the distance R and the depth W are expressed as follows:

$$S\leqq R<L<W.$$

12. A variable resistor in accordance with claim 10, wherein the O ring in a non-stressed condition has an inner diameter di and an outer diameter do, the stepped portion has an inner diameter Dc, and the boss portion has an outer diameter Ds with the following relationship:

$$di<Ds,$$

$$do\approx Dc.$$

13. A variable resistor in accordance with claim 10, wherein the O ring is twisted approximately 90 degrees in the cross sectional view.

14. A housing with a rotatable portion, comprising:

a case;

an O ring; and a shaft projecting from an upper surface of the case, wherein the case includes a stepped surface on an upper surface of the case, the stepped surface supporting the peripheral surface and the bottom surface of the O ring, the shaft includes a boss portion contacting the inner circumference of the O ring and an operating portion projecting from the upper surface of the case and covering the stepped surface of the case, the inner and outer circumferences of the O ring are in compressed contact with the stepped surface of the case and the boss portion of the shaft, and a gap is provided between either upper or lower end surface of the O ring and the stepped surface and the bottom surface of the operating portion.

15. A housing in accordance with claim 14, wherein the O ring has a diameter U and the stepped surface has a depth W and a distance R in the radial direction between the inner circumference of the stepped surface and the outer circumference of the boss portion, the diameter U, the depth W and the distance R having the following relationship:

$$R<U<W.$$

16. A housing in accordance with claim 14, wherein the O ring has an inner diameter di and an outer diameter do in a non-stressed condition, and the boss portion has a outer diameter Ds and the stepped surface of the case has an inner diameter Dc with the following relationship:

$$di<Ds$$

$$do\geq Dc.$$

17. A housing in accordance with claim 14, wherein, in assembled state, the O ring is transformed to have an ellipse shaped cross-section having a major length in the axial direction of the shaft.

18. A housing in accordance with claim 14, wherein the O ring in a non-stressed condition has an elliptical cross-section with a major axis of the cross section in the radial direction wherein a length of major axis of the ellipse is longer than the distance in the radial direction between the stepped surface and the boss portion, and the O ring is dimensioned to be pressed and fitted into between the stepped surface of the case and the boss portion of the shaft to apply a twisting or warping force to the O ring.

19. A housing in accordance with claim 14, wherein the O ring in a non-stressed condition is elliptical in the radial direction with a cross-sectional length L along a major axis and a cross-sectional thickness S, the stepped surface has a depth W in an axial direction of the shaft and a distance R exists between an inner circumference of the stepped surface and an outer circumference of the boss portion with the following relationship the major axis L, the thickness S, the distance R and the depth W are expressed as follows:

$$S\leq R<L<W.$$

20. A housing in accordance with claim 14, wherein the O ring in a non-stressed condition has an inner diameter di and an outer diameter do, the stepped portion has an inner diameter Dc, and the boss portion has an outer diameter Ds with the following relationship:

$$di<Ds,$$

$$do\approx Dc.$$

* * * * *